US006695151B2

(12) United States Patent
Chang et al.

(10) Patent No.: US 6,695,151 B2
(45) Date of Patent: Feb. 24, 2004

(54) SHELVING UNIT AND DISPLAY SYSTEM EMPLOYING SAME

(75) Inventors: Dennis Li-Ta Chang, East Brunswick, NJ (US); Christopher Thomas Rich, Lancaster, PA (US); Larry R. Enochs, Columbia, PA (US); Mark R. Hernick, Chadds Ford, PA (US)

(73) Assignee: Showtime Enterprises, Inc., Paulsboro, NJ (US)

( * ) Notice: Subject to any disclaimer, the term of this patent is extended or adjusted under 35 U.S.C. 154(b) by 0 days.

(21) Appl. No.: 10/080,733

(22) Filed: Feb. 22, 2002

(65) Prior Publication Data

US 2002/0113028 A1 Aug. 22, 2002

Related U.S. Application Data

(60) Provisional application No. 60/271,027, filed on Feb. 22, 2001.

(51) Int. Cl.[7] ..... A47F 7/00

(52) U.S. Cl. ..... 211/45; 211/46

(58) Field of Search ..... 211/45, 186, 187, 211/59.2, 46

(56) References Cited

U.S. PATENT DOCUMENTS

| | | | | | |
|---|---|---|---|---|---|
| 2,190,675 | A | * | 2/1940 | Patterson | |
| 4,604,061 | A | * | 8/1986 | Willcocks et al. | 211/45 |
| 5,029,715 | A | * | 7/1991 | Strada | 211/55 |
| 5,031,781 | A | * | 7/1991 | Price et al. | 211/45 |
| 6,006,926 | A | * | 12/1999 | O'Reilly et al. | 211/45 |
| 6,170,674 | B1 | * | 1/2001 | Caterinacci | 211/45 X |
| 6,286,689 | B1 | * | 9/2001 | Sherwood et al. | 211/45 |

* cited by examiner

*Primary Examiner*—Robert W. Gibson, Jr.
(74) *Attorney, Agent, or Firm*—Schnader Harrison Segal & Lewis LLP

(57) ABSTRACT

A shelving unit has left- and right-hand side rails for engaging the inner surfaces of opposed sidewalls of a display system. A generally trapezoidal bridge member having its upper lateral edge as the major side, is defined by two outer, longitudinal edges which slope inwardly at a prescribed angle as each moves from the upper lateral edge. The sloping longitudinal edges are adapted for frictionally engaging each respective side rail such that pressure exerted by the bridge member is sufficient to hold each side-rail in place between the inner walls of a display system. Each side rail and the bridge member define an upper surface for supporting a display item.

7 Claims, 4 Drawing Sheets

SHELVING UNIT AND DISPLAY SYSTEM EMPLOYING SAME

This application claims benefit of No. 60/271,027 filed Feb. 22, 2001

BACKGROUND

1. Field of Invention

The invention relates generally to shelving and shelving display systems. More particularly, the invention relates to a display shelf using a frictionally engaged bridge member between two side rails for displaying samples, particularly flooring samples.

2. Description of the Related Art

Display shelves of many varieties are widely known. Manufacturers and marketing departments are continually searching for new and better ways to display their products to potential buyers.

In the area of flooring, many samples must be readily visible and comparable in a single viewing. Flooring samples are typically mounted as rectangular or square sections, having some sort of identifier. These samples are often stacked in racks or other systems which allow customers to peruse through the many samples.

Page-style displays allow the customer to view several samples back to back and in one compact display. However, these displays generally do not allow for easy removal of the sample item for replacement or viewing. Since flooring is usually viewed looking downward from eye level, a customer can get a better idea of how the flooring will look if he is able to place it flat on the floor, rather than hanging vertically.

There is a need, particularly in the flooring industry, to have a display system where samples are easily viewed and compared, while being easily removed for viewing away from the display system.

Additionally, to keep pace with the ever changing demand, the display systems themselves may require updating, or shuffling of shelving units to allow introduction of new styles or removal of older styles. To do this, the display system must have flexibility to increase or decrease the number of shelves and the spaces between them. Traditional fasteners such as screws require time and effort for assembly and disassembly of parts. Thus, there is a need for a simple shelving device which does not require screws or other fasteners and that is easily removable, adjustable, or addable to a base display system.

SUMMARY OF THE INVENTION

A shelving unit has left- and right-hand side rails for engaging the inner surfaces of opposed sidewalls of a display system. A generally trapezoidal bridge member having its upper lateral edge as the major side, is defined by two outer, longitudinal edges which slope inwardly at a prescribed angle as each moves from the upper lateral edge. The sloping longitudinal edges are adapted for frictionally engaging each respective side rail such that pressure exerted by the bridge member is sufficient to hold each side-rail in place between the inner walls of a display system. Each side rail and the bridge member define an upper surface for supporting a display item.

DETAILED DESCRIPTION

Figure 1:
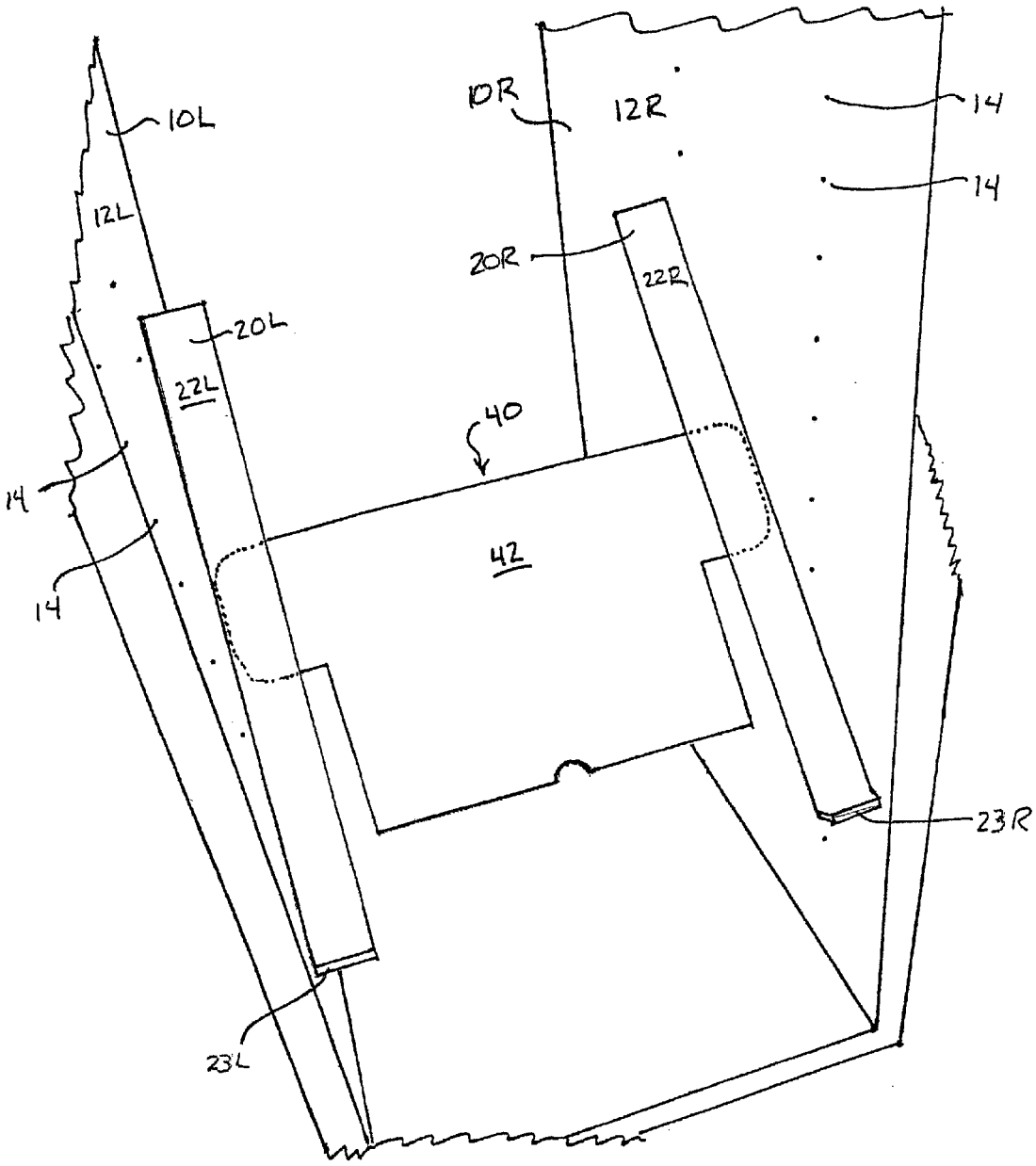
FIG. 1 is a perspective view of a shelving unit and display system in accordance with an embodiment of the invention.

Referring to the Figures and reference numerals, the invention is described. The following description relates to the preferred embodiments, and is not intended to be a limiting description. The reference letters L and R are attached to general reference numerals to designate specific left and right hand elements. The general reference numerals are used when the left and right hand designations are not needed. Generally speaking, the left and right portions are mirror images of each other, thus, the description applies equally to both left- and right-hand elements.

FIG. 1 shows the display system with one shelving unit in place. The display system has two opposed sidewalls 10L, 10R with inner surfaces 12L, 12R facing each other. Each sidewall preferably defines a plurality of small apertures 14 arranged in at least two parallel rows. These apertures 14 are ultimately used to aid in uniform placement of multiple shelving units. The distance separating each sidewall varies with sample size, and potentially from manufacturer to manufacturer. Presently, the inventors contemplate nine and twelve inch sample widths, although any width may be used.

Several shelving units are used in each display system, although FIG. 1 illustrates only one unit for clarity. Each shelving unit has a left rail 20L, a right rail 20R, and a bridge member 40. The left and right rails are mirror images of each other, and most preferably are installed at an angle for displaying the flooring samples. The bridge member 40 engages, at opposite edges each rail 20L, 20R, and pushes each rail toward its respective display system sidewall 10. The lateral pressure exerted by the bridge member 40 is sufficient to hold the entire shelving unit in place.

Each side rail 20 has an upper planar surface 22 for supporting the sample (not shown), and an end flange 23 for preventing the sample from sliding off the shelf when displayed at an angle. The side rail 20 is also provided with a side wall 24, which extends perpendicularly downward from the upper surface 22. This sidewall 24 has an outer surface 26 for engaging the inner surface 12 of the display system sidewall 10, and an inner surface 28 which engages an edge of the bridge member 40. In a preferred embodiment, the side rail 20 is provided with at least two outwardly extending pins 29 protruding from said outer surface 28 of said side rail side wall 24. Each pin 29 is received into an aperture 14 in the respective display system sidewall 10. This arrangement is preferably not sufficient to hold the side rail 20 in place, but merely serves as a guide for locating the side rail. This guidance allows opposed side rails to be oriented properly with respect to each other. Although the pins 29 could be used to secure the rails, this is not preferred because of the added effort required to secure and remove such side rails.

Figure 4:
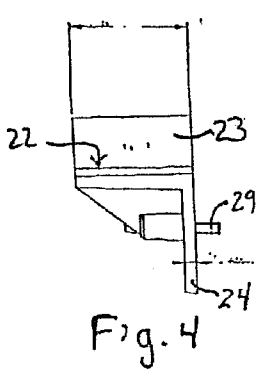
FIG. 4 is an [upper back] end view of a left side rail in accordance with an embodiment of the invention.
Figure 2:
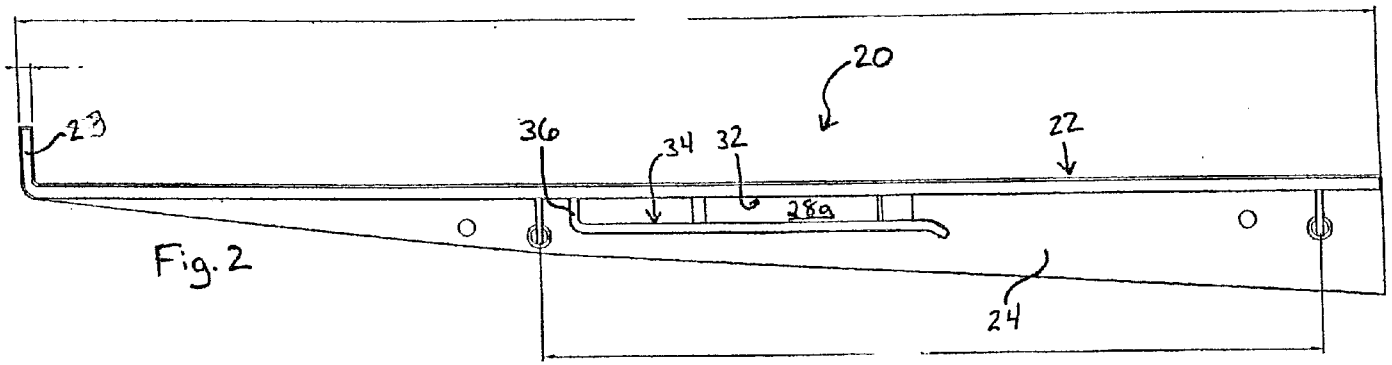
FIG. 2 is an inside elevational view of a left side rail in accordance with an embodiment of the invention.
Figure 3:
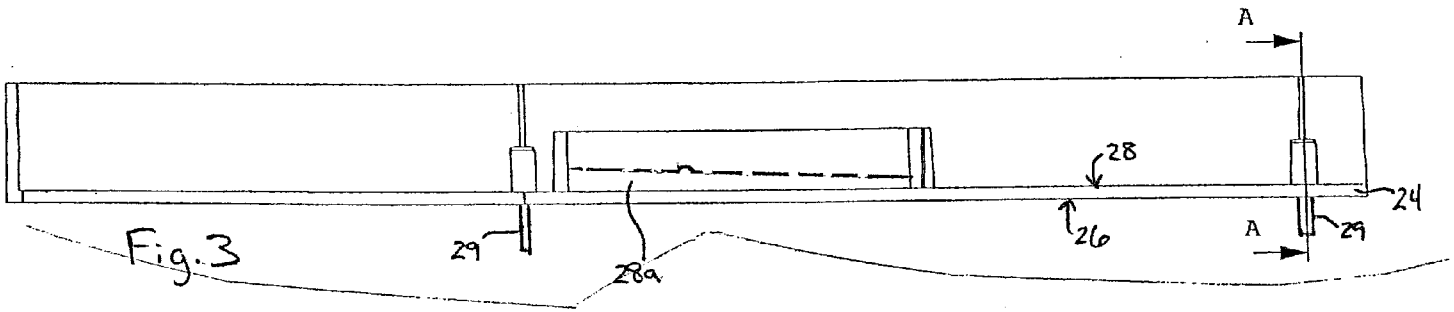
FIG. 3 is a bottom plan view of a left side rail in accordance with an embodiment of the invention.
Figure 7:
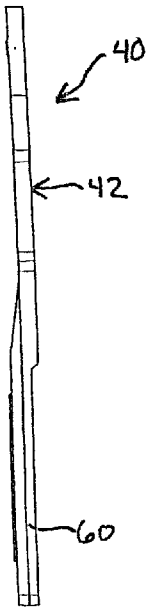
FIG. 7 is a side elevational view of a bridge member in accordance with an embodiment of the invention.
Figure 5:
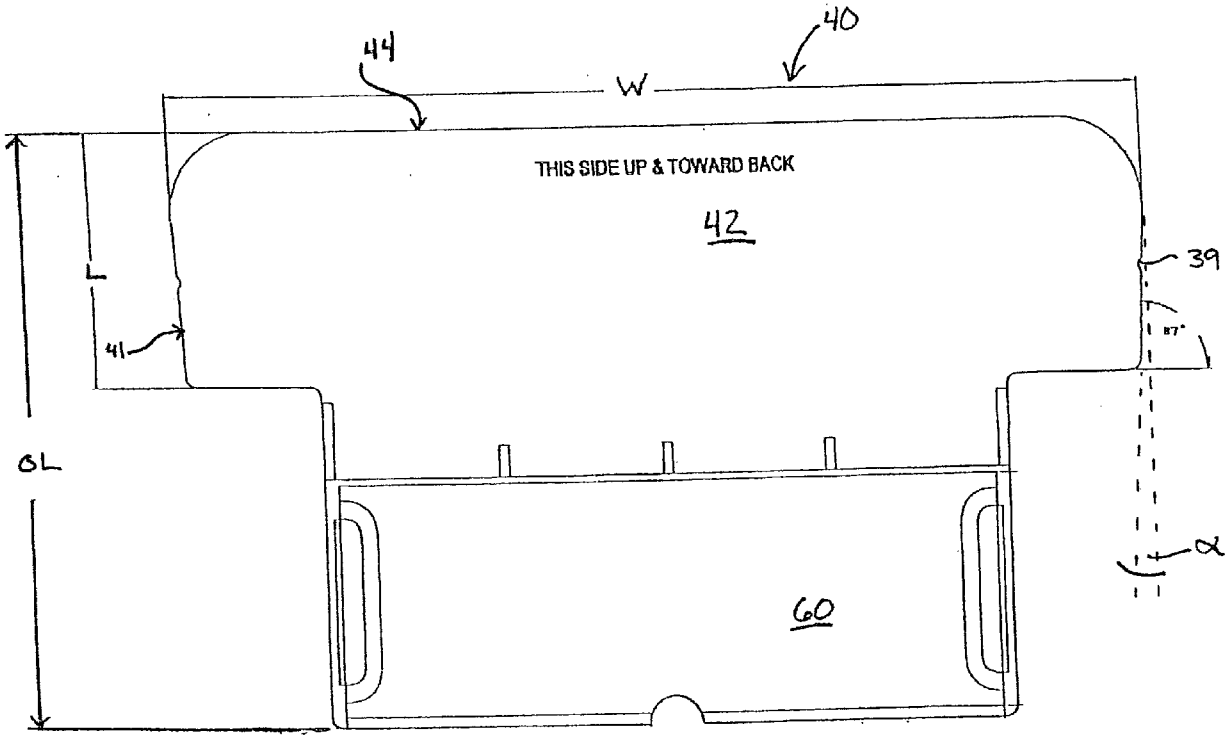
FIG. 5 is a plan view of a bridge member in accordance with an embodiment of the invention.
Figure 6:
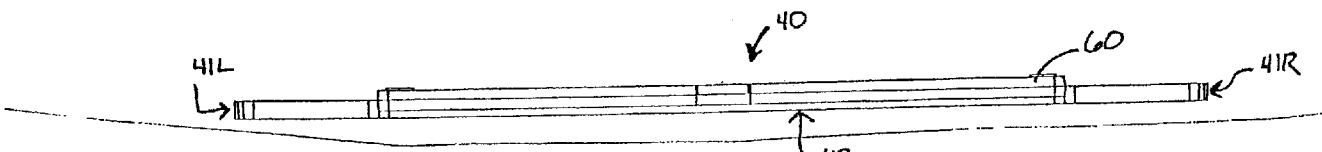
FIG. 6 is front elevational view of a bridge member in accordance with an embodiment of the invention.

FIGS. 2–4 show a bridge engaging member located on the inner surface 28 of the side wall 24 of each side rail 20. The bridge engaging member has opposed upper and lower surfaces 32, 34 which define a slot for receiving an edge of the bridge member. An end wall 36 is shown, but is not necessary, since the bridge is held in place by friction and outwardly exerted pressure. End wall 36 accounts for manufacturing differences and aids assembly by hindering over-insertion of the bridge member. Between upper and lower surfaces 32, 34, the a portion 28*a* of the side rail sidewall 24 protrudes into the slot and slopes inwardly as it progresses toward the end flange 23. Optionally, the sloping side wall portion 28*a* is provided with a mating member 38 for engaging a complimentary member 39 on the bridge member edge. As shown, the mating member 38 of the side rail preferably is a rounded protrusion.

Figure 8:
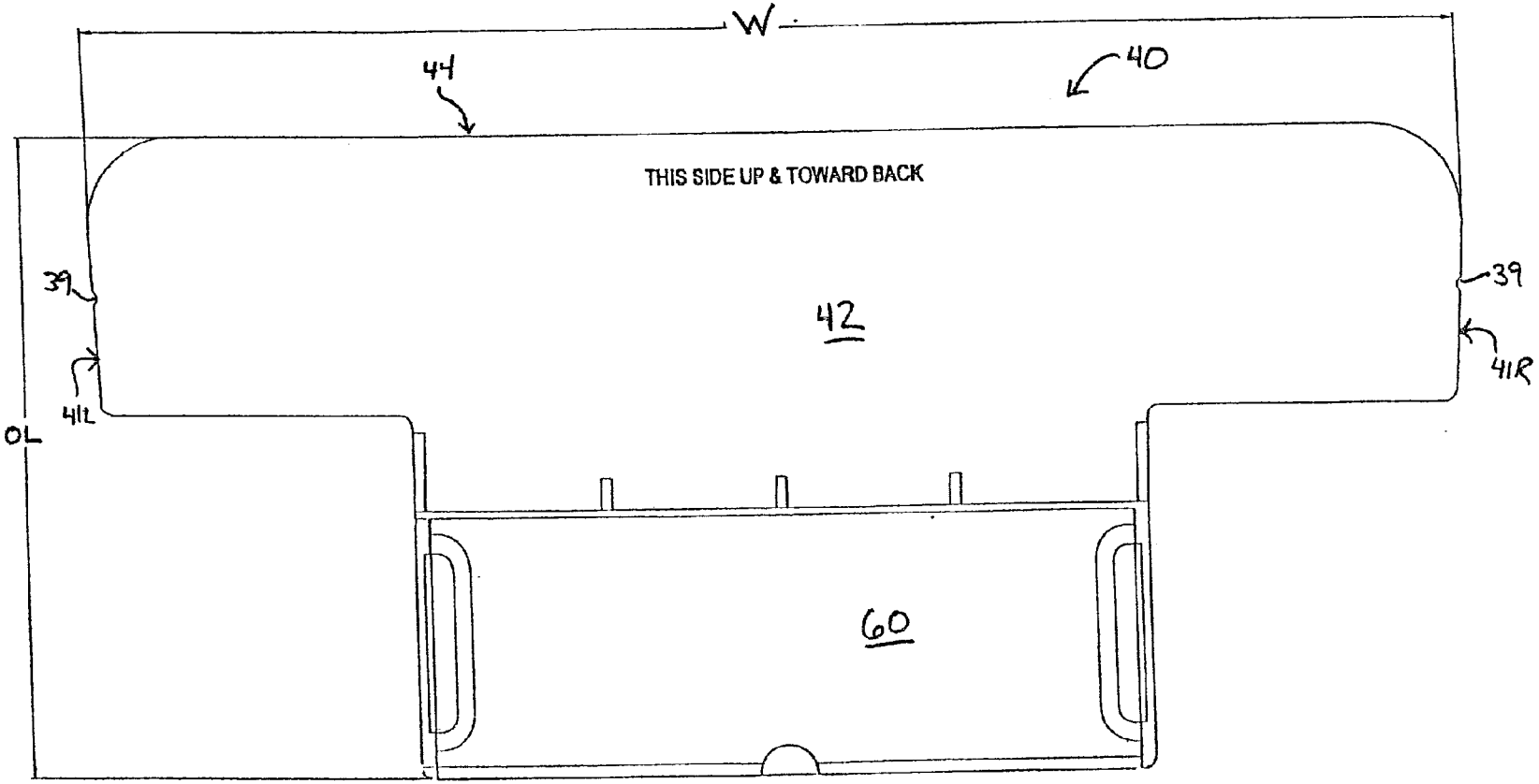
FIG. 8 is a plan view of an alternative bridge member in accordance with an embodiment of the invention.

FIGS. 5–8 show the bridge member; FIG. 8 shows a wider version of the bridge member. The bridge member is generally trapezoidal having an upper, lateral major side 44 of width W. The bridge member is provided with an upper surface 42 for supporting a sample, not shown. Each longitudinal side edge 41 tapers inwardly from the upper lateral side 44. Preferably, the taper angle a is approximately three degrees (3°) from the perpendicular although a broad range is certainly possible. The minor side 46 is preferably modified for carrying sample identifying markings, or even interchangeable point-of-purchase marketing information and advertising 60. Each longitudinal edge 41 may also be provided with a mating member 39 corresponding to the mating member 38 of its respective side rail 20. As shown, the mating member 39 of the bridge member longitudinal edge 41 preferably is a rounded notch.

Each of the pieces is preferably made from injection molded plastic. The characteristics of the molded article will be determined by the design engineer, based upon the distance between the side rails when installed, and the weight of the sample to be supported. Shelving and shelving systems display for ceramic tiles and other heavy materials may require greater strength than displays for lighter wood flooring.

In use, the shelving and shelving display system is constructed for accepting a specified sample width. Each side rail 20 is loosely placed at the corresponding sidewall 10 of the display system. The appropriately sized bridge member 40 is then slid into place such that its sloping edges 41 engage the side rails 20 and force them outward, until the display system sidewalls 10 are securely engaged by each side rail 20, which in turn are frictionally engaged by the bridge member 40.

This process is repeated with a plurality of shelving units in each display system. Adjacent shelving units are displaced vertically from each other to allow easy viewing and access to all samples held on the upper surface of the shelves. No tools are required to add or remove additional shelving units.

Although sample sizes will vary, the side rails are identical regardless of sample size. It should be recognized that the length of the side rail should be sufficient to receive the bridge member, and more importantly, sufficient to prevent the sample from teetering forward or backwards. Generally, the width of the upper surface of the side rail, upon which a sample sits, is one inch. The thickness of the side flange, reduces the width required of the bridge member, and is generally around 0.1 inch, but may vary with strength requirements or other factors. These simple side rails can be used interchangeably from display to display, regardless of sample width.

The bridge member 40 may be made to any specified parameter. In light of the above description, the width of the bridge member will necessarily be somewhat smaller than the sample to be displayed. In the contemplated 9 inch model, the bridge member, at its widest point W is approximately 8.898 inches. Its longitudinal edges taper at approximately 3° for approximately 2.3. inches L. In the 12 inch model, the greatest width W is 11.712 inches, with an identical slope. In each case, it is contemplated that the overall length OL of the bridge member 40 is constant at about 5.297 inches. Of that, 2.3 inches (L) span the entire width and engage the side rails 20. The remaining length is used to house identifying information or point-of-purchase materials. Of course, the required length of the side rail engaging portion may be subject to variation for various reasons such as strength determination. For that matter, the remaining portion of the bridge member 40 may be made to any dimension necessary to carry the desired information.

The shelving and shelving display system described herein provides a simple, cost effective solution to the ever changing display needs found especially in the flooring industry. The invention provides the advantage of tool-less assembly and limits the need for hardware. Thus, factory and especially field installation and reconfiguration are easily achieved. While the invention is set out fully above, it should be noted that those skilled in the art will readily ascertain that other embodiments of the invention may be readily employed. The invention is not limited to the above description, but covers the entire scope of the claims below.

What is claimed is:

1. A shelving unit comprising:

a left-hand side rail;

a right-hand side rail;

a bridge member defined by an elongated upper lateral edge and two outer, longitudinal edges which extend inwardly at a prescribed angle from the upper lateral edge;

wherein the longitudinal edges are adapted for frictionally engaging each of said left-hand side rail and said right-hand side rail such that pressure exerted by the bridge member is sufficient to hold said left-hand and said right-hand side rails in place between the inner walls of a display system; and wherein said left-hand and said right-hand side rails and the bridge member form an upper surface for supporting a display item.

2. The shelving unit of claim 1, wherein:

each side rail is provided with a bridge-engaging member having upper and lower surfaces defining a slot therebetween for receiving a longitudinal edge of said bridge member, and having a tapered sidewall corresponding to the slope of said longitudinal edge.

3. The shelving unit of claim 1, wherein:

each side rail is provided with externally protruding pins for receipt in corresponding apertures in the display system for maintaining each side rail in a predetermined location when under pressure created by insertion of the bridge member.

4. The shelving unit of claim 1, wherein:

each side rail and the corresponding longitudinal edge of said bridge are provided with a mating members for additional frictional engaging power.

5. The shelving unit of claim 1, wherein:

the prescribed angle for each longitudinal edge is approximately three degrees (3°).

6. The shelving unit of claim 1, wherein:

a lower lateral edge is extended and adapted for housing labeling materials.

7. A display system comprising:

left- and right-hand opposed sidewalls having inner surfaces parallel to and facing each other;

a plurality of vertically displaced shelving units, each shelving unit comprising:

a left- and right-hand side rails;

a bridge member wherein an upper lateral edge is the major side, as defined by two outer, longitudinal edges which extend inwardly at a prescribed angle from the upper lateral edge;

wherein the angled longitudinal edges are adapted for frictionally engaging each respective side rail such that pressure exerted by the bridge member is sufficient to hold each side-rail in place between the inner surfaces of said sidewalls of said display system; and wherein each side rail and the bridge member have an upper surface for supporting a display item.

* * * * *